US005431313A

United States Patent [19]

Renault

[11] Patent Number: 5,431,313

[45] Date of Patent: Jul. 11, 1995

[54] FLUID DISPENSING DEVICE WITH PUSH-BUTTON ACTUATOR

[75] Inventor: Philippe Renault, Paris, France

[73] Assignee: L'Oreal, Paris, France

[21] Appl. No.: 298,957

[22] Filed: Sep. 1, 1994

[30] Foreign Application Priority Data

Sep. 15, 1993 [FR] France ..... 93 10988

[51] Int. Cl.[6] ..... B65D 83/00

[52] U.S. Cl. ..... 222/402.13; 222/509

[58] Field of Search ..... 222/402.13, 509, 182, 222/321

[56] References Cited

U.S. PATENT DOCUMENTS

| | | | |
|---|---|---|---|
| 2,685,989 | 8/1954 | Samuels | 222/402.13 |
| 3,618,827 | 11/1971 | Melocchi . | |
| 4,067,482 | 1/1978 | Vogel et al. | 222/402.13 |
| 4,141,471 | 2/1979 | Nozawa et al. | 222/402.13 X |
| 4,264,037 | 4/1981 | Nozawa | 222/402.13 X |
| 5,242,090 | 9/1993 | Reyss . | |
| 5,249,713 | 10/1993 | Reich et al. | 222/402.13 X |
| 5,337,929 | 8/1994 | de Laforcade | 222/402.13 X |

FOREIGN PATENT DOCUMENTS

| | | | |
|---|---|---|---|
| 0402636 | 12/1990 | European Pat. Off. | 222/402.13 |
| 2083712 | 12/1971 | France . | |
| 2675403 | 10/1992 | France . | |
| 1575046 | 1/1970 | Germany . | |

*Primary Examiner*—Gregory L. Huson
*Attorney, Agent, or Firm*—Young & Thompson

[57] ABSTRACT

Device for dispensing a fluid product, comprising a container (102) fitted with a dispensing member (103) comprising a dispensing head (104) which can be moved in translation and is fitted with a button (104*a*). A cap (106) covers the container (102) and the dispensing head (104), on which cap a lever (107) is articulated. The lever carries a bearing element (109) capable of bearing on the button (104*a*) of the dispensing head (104) in order to push in the dispensing head (104). The bearing element (109) has, in cross-section through a plane of rotation of the lever (107), a shape such that a force applied to the end of the lever (107) is transmitted to a constant point (P) of the button of the dispensing head (104) and in that while the head (104) is being pushed in, the point (P) of application of the force moves parallel to the axis of translation (X—X) of the head (104) of the dispensing member. The bearing element (109) more particularly has the shape of an involute of a circle (C).

6 Claims, 2 Drawing Sheets

FLUID DISPENSING DEVICE WITH PUSH-BUTTON ACTUATOR

BACKGROUND OF THE INVENTION

The present invention relates to a device for dispensing a fluid product, that is to say a product in the form of a liquid or paste or a cream of greater or lesser viscosity. The fluid product can be dispensed in the sprayed form, that is to say in the form of fine droplets, spray or aerosol or in foam form.

FIELD OF THE INVENTION

Numerous devices are known for dispensing a fluid product in sprayed or foam form. They generally comprise a container containing the fluid product to be dispensed, it being possible for this container to be pressurized or unpressurized, which is fitted with a member for dispensing the product (valve or pump). This dispensing member conventionally contains a part which can be moved in translation and is actuated by pushing in. The movable part of the dispensing member generally consists of a dispensing head including a channel, a nozzle for dispensing the product and a button on which pressure is exerted in order to push the movable part of the dispensing member in. The user can act directly manually on the dispensing head but, in order to reduce the effort necessary to actuate the dispensing member, it is known to use a lever. In this case, the dispensing head and the container are generally covered with a cap on which the lever is articulated, it being possible for the articulation to consist of a hinge film, the lever then being moulded integrally with the cap, or to consist of another system, with the lever and the cap forming two separate parts. The said lever is fitted with an element for bearing on the button of the dispensing head. The button preferably has a plane upper surface which is generally perpendicular to the axis of translation of the movable part. This button may include elements which form a guide for the bearing element so as to prevent any lateral displacement of the said bearing element. The said bearing element is located between the articulation of the lever onto the cap and the free end of the lever on which the user presses. An opening is, of course, made in the cap, in front of the spray nozzle of the dispensing head. Dispensing devices of this type are, for example, described in EP-A 0,402,436, FR-A 2,319,540 and FR-A 2,675,403.

In devices hitherto proposed, the bearing elements consisted either of a point or of a cam having in cross-section, through the plane of rotation, the shape of a segment of a circle, or of a sphere or a spherical cap. This type of bearing element has the following drawback: the resultant of the forces applied by the user on the lever and of the frictional forces of the element of the dispensing member on the sprayer itself leads to a deformation of the movable part of the dispensing member which, under the effect of this force, no longer slides in a plane corresponding to the axis of the sprayer itself. Furthermore, the bearing point of the force slides along the button of the dispensing head and the bearing conditions are altered.

These drawbacks are diagrammatically illustrated in the attached FIG. 1. This FIG. 1 shows a device including a movable part 1 moving in translation along the axis X—X of a coaxial tubular element 2. A lever 3 is fitted with a bearing element 4 consisting of a cam which has, in cross-section, the shape of a segment of a circle. The bearing element 4 bears on the surface 1*a* perpendicular to the axis X—X of translation of the movable part 1 forming the button. The theoretical exerted force Ft is perpendicular to the straight line joining the bearing point to the articulation point and it consequently makes an angle $\alpha$ with the axis X—X. Furthermore, it is necessary to take into account the frictional forces Ff and the transmitted resultant force F makes an angle greater than the angle $\alpha$ with the axis X—X. The downwards force Fd is small. The movable element 1 therefore tends to pivot and deform. When it is pushed into the tubular element 2, the movable element 1 will therefore rub against the inner walls of the tubular element 2 and it is possible for this friction to increase until it blocks the movable element 1. The various elements of the dispensing member become fragile, because they are subjected to deformations each time the dispensing member is actuated. Furthermore, the bearing point of the cam 4 on the surface 1*a* moves when the button is pushed in, which alters the conditions of application of the force on the dispensing member as a function of the lowering of the lever.

In summary, the drawbacks referred to lead to an overall deformation of all the parts of the dispensing member, which can lead to excessive friction, blocking of the various sliding parts, and above all overall weakening of the dispensing member.

The object of the invention is, in particular, to remedy these drawbacks.

SUMMARY OF THE INVENTION

According to the present invention, it has been found that it is possible to avoid the drawbacks described hereinabove by using as the bearing element of the lever a cam having, in cross-section through a mid-plane of rotation of the lever, a shape such that the force exerted by the user is transmitted to the surface of the dispensing head at a constant point lying on the axis of translation of the movable part of the dispensing member or on a line parallel to the said axis of translation.

The subject of the present invention is consequently a device for dispensing a fluid product, comprising a container fitted with a dispensing member comprising a dispensing head which can be moved in translation and is fitted with a button, and a cap covering the container and the dispensing head, on which cap a lever is articulated, the lever carrying a bearing element capable of bearing on the button of the dispensing head in order to push in the dispensing head of the dispensing member, characterized in that the bearing element has, in cross-section through a plane of rotation of the lever, a shape such that a force applied to the end of the lever is transmitted to a constant point of the button of the dispensing head and in that while the head is being pushed in, the point of application of the force moves parallel to the axis of translation of the head of the dispensing member.

Preferably, the bearing element is a cam whose cross-section through a plane of rotation of the lever is bounded by an involute of a circle centered on the axis of articulation of the lever, this axis of articulation being located above the plane on which the bearing force is exerted on the button. The circle involute is advantageously the one tangent to the button of the dispensing head when the lever is in the resting position.

The point of application of the force is preferably located at the centre of the button of the dispensing head, on the axis of translation of the movable head of the dispensing member. Under these conditions, the point of application of the force is located on the axis of translation of the movable part of the dispensing member. The deformations are thereby reduced.

Advantageously, the axis of the articulation between the lever and the cap is formed by a hinge film. In this case, the lever and the cap are moulded in monobloc form. It is also possible to design the lever and the cap in two separate parts, the articulation being formed by any conventional arrangement, for example by engagement of two pivots made on the lever in corresponding recesses of the cap.

BRIEF DESCRIPTION OF THE DRAWINGS

The description given hereinbelow of an embodiment of an assembly according to the invention, by way of illustration and without limitation, with reference to the attached drawing, will make it possible better to understand the invention.

On this drawing.

DETAILED DESCRIPTION OF THE INVENTION

Figure 1:
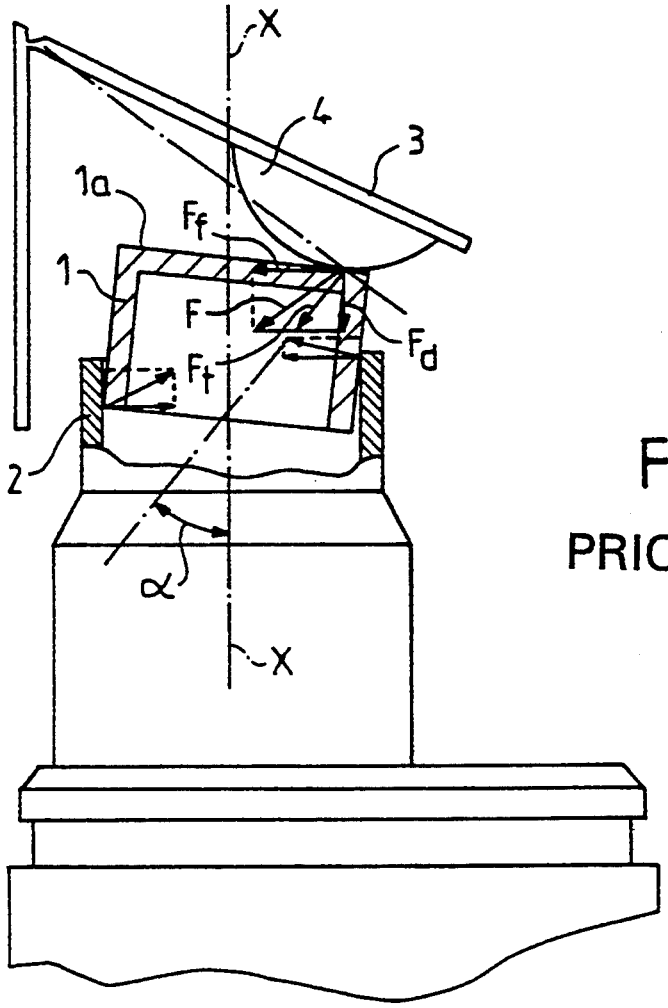
FIG. 1 PRIOR ART
FIG. 1 is a schematic view in cross-section of a dispensing assembly according to the prior art, the description of which was given hereinabove.
Figure 2:
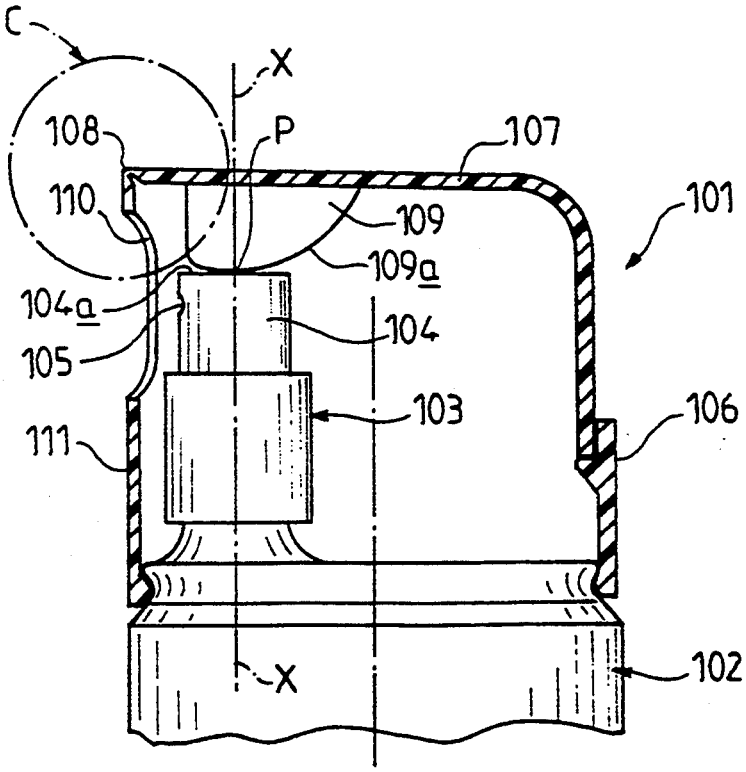
FIG. 2 is a partial view in cross-section of a dispensing assembly according to the invention, in the resting position.

FIG. 2 represents, in partial cross-section, an assembly 101 according to the invention which includes a container 102 (partially represented) on which a pump 103 is fixed, the movable part of which pump consists of a dispensing head 104 fitted with a spray nozzle 105. The container 102 and the dispensing head 104 are covered by a cap 106 fitted with a lever 107 fixed to the cap 106 by a hinge film 108. A hinge film 108 is linear and it is located in the vicinity of the point of connection between the peripheral skirt 111 of the cap fixed by snap-fastening on the container 102 and the upper surface of the cap. The lever 107 is formed by a cut-out in the upper surface of the cap.

The lever 107 carries a bearing element 109 which consists of a cam whose side surfaces are parallel to the mid-plane of the lever and are slightly separated from each other. The bearing surface 109*a* of the element 109 is cylindrical, with generatrices parallel to the axis of articulation formed by the hinge film 108. In other words, the direction of the generatrices is perpendicular to the plane of FIG. 2. The cross-section of the surface 109*a*, to the mid-plane of the lever 107 orthogonal to the generatrices is an involute of the circle C centered on the hinge film 108 and tangent to the axis X—X of the head 104.

The upper surface 104*a* of the head 104 is plane and orthogonal to the axis X—X and is bounded by a circular contour centered on the said axis X—X. The head 104 is a cylinder of revolution. The upper surface 104*a* constitutes a button.

The involute 109*a* of the circle C is chosen so as to be tangent to the centre of the button 104*a*, at a point P, on the axis X—X when the assembly is at rest.

The axis of rotation of the lever 107, consisting of the hinge film 108, is located above the plane of the button 104*a*, that is to say on that side of the said button 104*a* which lies opposite the container 102.

Lateral guide means may be provided between the cam 109 and the head 104. These may, for example, be a groove or a shoulder (not shown), provided on the button 104*a*, with which the cam 109 interacts for holding along a direction perpendicular to the plane of FIG. 2.

The cap 106 is provided with an opening 110 arranged in front of the nozzle 105 so as to allow passage of the jet of sprayed fluid product.

Figure 3:
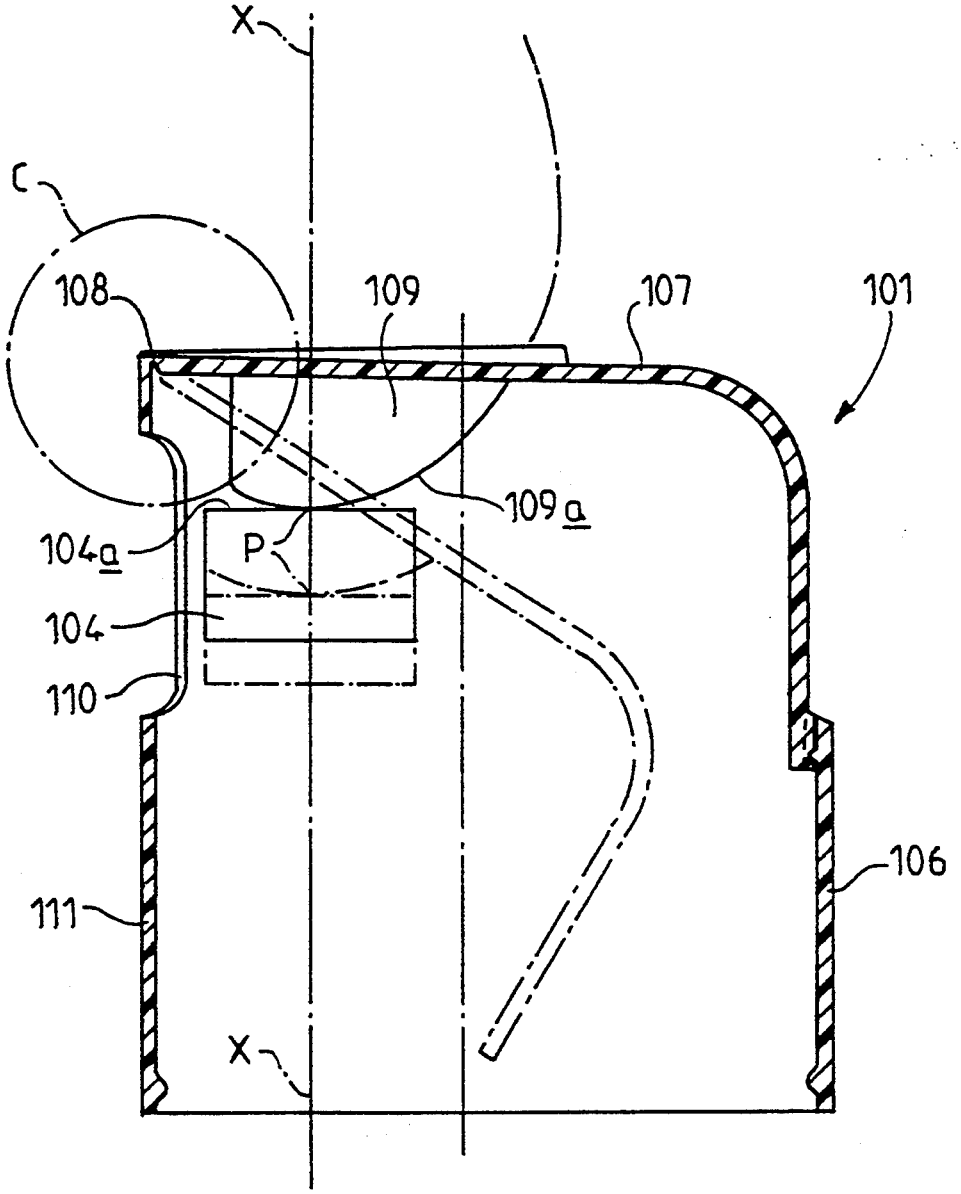
FIG. 3 is a diagram illustrating the operation of a dispensing assembly according to the invention.

The diagram in FIG. 3 makes it possible to understand the operation of the assembly and the mode of action of the cam 109 in the form of a circle involute.

In FIG. 3, the lever 107 has been represented by solid lines in the resting position and in dots and dashes in the maximum insertion position.

It will be recalled that the profile 109*a* is the involute of the circle C centered on the axis of articulation 108 and tangent to the axis X—X of the button. At rest, the involute 109*a* is tangent to the face 104*a* at its centre P.

When the lever 107 is pushed in, so as to turn clockwise about the axis 108 of articulation, the cam 109 is lowered and pushes in the head 104. The profile 109*a* in the form of a circle involute remains in contact with the constant point P (centre) of the face 104*a*. This point P moves along the axis X—X of the head 104, to which the circle C is tangent.

The friction between the parts is reduced and the sliding conditions of the head 104 are improved.

I claim:

1. Device for dispensing a fluid product, comprising a container (102) fitted with a dispensing member (103) comprising a dispensing head (104) which can be moved in translation and is fitted with a button (104*a*), and a cap (106) covering the container (102) and the dispensing head (104), on which cap a lever (107) is articulated, the lever carrying a bearing element (109) capable of bearing on the button (104*a*) of the dispensing head (104) in order to push in the dispensing head (104) of the dispensing member (103), said bearing element having, in cross-section through a plane of rotation of the lever (107), a shape such that a force applied to the end of the lever (107) is transmitted to a constant point (P) of the button (104*a*) of the dispensing head (104) and in that while the head (104) is being pushed in, the point (P) of application of the force moves parallel to the axis of translation (X—X) of the head (104) of the dispensing member, and said bearing element (109) being a cam whose cross-section through a plane of rotation of the lever (107) is bounded by an involute (109*a*) of a circle (C) centered on the axis (108) of articulation of the lever (107), said axis of articulation being located above the plane on which the bearing force is exerted on the button.

2. Device according to claim 1, wherein the circle (C) is tangent to the axis (X—X) of the head (104).

3. Device according to claim 1, wherein the circle involute (109*a*) is tangent to the button (104*a*) of the dispensing head (104) when the lever (107) is in the resting position.

4. Device according to both of claim 2, wherein the point (P) of application of the force is located at the centre of the button (104*a*) of the dispensing head (104), on the axis (X—X) of translation of the movable head (104) of the dispensing member.

5. Device according to one of claim 1, wherein the axis (108) of articulation of the lever (107) consists of a hinge film.

6. Device according to claim 1, wherein the lever (107) and the cap (106) form two separate parts which are articulated to each other.

* * * * *